United States Patent [19]

Munakata et al.

[11] Patent Number: 4,634,628

[45] Date of Patent: Jan. 6, 1987

[54] RECORDING MEDIUM AND IMAGE RECORDING PROCESS

[75] Inventors: Hirohide Munakata; Yoshinori Tomida, both of Yokohama; Masahiro Haruta, Funabashi; Yutaka Hirai, Tokyo; Yukuo Nishimura, Sagamihara; Takashi Hamamoto, Yokohama, all of Japan

[73] Assignee: Canon Kabushiki Kaisha, Tokyo, Japan

[21] Appl. No.: 680,663

[22] Filed: Dec. 12, 1984

[30] Foreign Application Priority Data

Dec. 22, 1983 [JP] Japan ..... 58-240938

[51] Int. Cl.[4] ..... G03C 5/00

[52] U.S. Cl. ..... 430/325; 430/326; 430/962; 430/495; 430/496; 430/523; 430/271

[58] Field of Search ..... 430/374, 541, 326, 962, 430/495, 523, 325, 496, 271

[56] References Cited

U.S. PATENT DOCUMENTS 3,694,207 9/1972 Matejec et al. ..... 430/374
4,356,256 10/1982 O'Brien et al. ..... 430/495

OTHER PUBLICATIONS

Karube, et al., "Control of Fixed-Enzyme Reaction" Kagaku, 1981, Apr., pp. 57-61.

Kosar, Light-Sensitive Systems, John Wiley & Sons, Inc., New York, Aug. 27, 1965, p. 54.

*Primary Examiner*—Won H. Louie

*Attorney, Agent, or Firm*—Fitzpatrick, Cella, Harper & Scinto

[57] ABSTRACT

A recording medium and an image recording process in which a change in enzyme activity by light irradiation is utilized.

9 Claims, 2 Drawing Figures

RECORDING MEDIUM AND IMAGE RECORDING PROCESS

BACKGROUND OF THE INVENTION

1. Field of the Invention

The present invention relates to an image recording process, and more particularly to an image recording process in which a selective reaction catalyzed by a fixed enzyme is utilized and to a recording medium used in this process.

2. Description of the Prior Art

Enzyme-catalyzed chemical reaction generally has advantages in that the rate of reaction is markedly higher than that of common chemical reaction under the conditions of ordinary temperature and pressure and that the selectivity of reaction is excellent because an enzyme promotes only a particular reaction.

It has been reported in recent years that the activity of an enzyme can be controlled with light by the chemical modification of the enzyme with a photochromic substance (reference: Y. Karube and S. Suzuki, "Control of Fixed-Enzyme Reaction" in Kagaku Kogyo, 1981, April, pp. 57–61). According to the report, the chemical modification of, for example, an amylolytic enzyme amylase with a spiropyrane, which is a photochromic substance, causes a decrease in the activity of amylase when this enzyme is exposed to light.

SUMMARY OF THE INVENTION

The present invention originates in noting such a property of enzyme as stated above. Thus an object of the present invention is to provide a novel recording medium and image recording process in which said enzyme property is utilized.

According to the present invention, there is provided a recording medium comprising (1) an enzyme layer composed of an enzyme the activity of which can be increased or decreased by light irradiation and a carrier on which the enzyme is fixed and (2) a recording layer composed of a mixture of a recording material and a substance which is decomposable by the action of the enzyme only in the presence of a developing liquid, and there is also provided an image recording process which comprises irradiating said recording medium with a pattern of light and developing the resulting latent image.

DETAILED DESCRIPTION OF PREFERRED EMBODIMENT OF THE INVENTION

Figure 1:
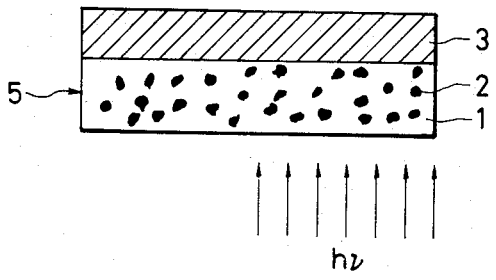
FIG. 1 is a schematic vertical sectional view of a recording medium according to the present invention.

The property of increasing or decreasing an enzymatic activity under light irradiation can be provided by two methods to the enzyme fixed on the carrier in the above-mentioned enzyme layer. One of the methods is to give such a property to the enzyme itself. The other method is to afford a substance which will cause the enzyme to exhibit such property, not to the enzyme but to the carrier. The former method comprises the chemical modification of the enzyme with a compound which on light irradiation changes its own structure or property. Such compunds includes, for example spiropyranes such as 3,3'-dimethyl-8-methoxy-6-nitrospiro[2H-1-benzopyrane-2,2'-indoline]-1'-propionic acid and 1,3,3'-trimethylindolino-2-spiro-6'-benzopyrane and the like, stilbene, salicylideneaniline, malachite green leuconitrile, hexaphenylbiimidazolyl, and cinnamoylimidazole. The latter method comprises a similar treatment of the carrier. Thereby, it is possible to make the enzyme fixed by the carrier have the above-mentioned property.

The recording material that is a component of the recording layer, in the invention, is a material for image formation and preferably selected from colorants so as to enhance the contrast to the enzyme layer. Such colorants include organic dyes such as copper phthalocyanine, thioindigo, indigo, diaminodiphenylmethane, benzanthrone, melanines and the like, and inorganic pigments.

The substance decomposable by the action of the fixed enzyme in the presence of a developing liquid is selected according to the nature of the developing liquid to be used. Suitable materials for this substance include, for example, starch, proteins, urea, glucose, tyrosine, indoxyl acetate, isatin acetate, polyglutamate, and milk casein. Suitable enzymes for decomposing these materials include, for example, α-chymotrypsin, pepsin, trypsin, tyrosinase, amylase, endopeptidase, urease, glucose oxidase, and macerating enzyme. Choice of the carrier for fixing the enzyme depends upon the nature of the developing liquid used. For instance, when the developing liquid is water, there may be cited collagen, polyacrylamide, cellulose, and porous glass as suitable examples of the carrier material.

For recording effectively an image on the recording medium of the present invention, it is desirable that the enzyme is dispersed uniformly on the carrier in the enzyme layer or at least in its interfacial layer contiguous to the recording layer.

For more effective recording, the recording material in the recording layer is desired to be mixed uniformly with the substance decomposable with the enzyme.

It is also possible that hydrophobic or hydrophilic groups are introduced into the enzyme and the enzyme layer is formed by the Langmuir-Blodgett method, thereby obtaining a high density and high resolution image.

Referring now to the drawings, the present invention is described in detail.

FIG. 1 is a schematic vertical sectional view of a recording medium according to the present invention. In this figure; 5 is the fixed-enzyme-containing layer; 1 is the carrier (collagen in this case) for fixing the enzyme; 2 is the enzyme fixed on the carrier 1, and in this case the enzyme is α-amylase, which is an amylolytic enzyme, chemically modified with a spiropyrane that acts as an inhibitor reducing the activity of α-amylase under light irradiation; and 3 is the recording layer formed on the fixed-enzyme layer 5, and in this case the recording layer is composed of starch, which is decomposable by the action of the enzyme only in the presence of a developing liquid (water in this case), and an organic pigment copper phthalocyanine(the starch-to-copper phthalocyanine ratio: 50/50 part by weight). Desirably, the fixed-enzyme layer 5 and the recording layer 3 have each a thickness of 40 to 100,000 Å.

Recording an image on the recording medium of said structure is carried out in the following manner: First, the recording medium stored in a dark room is irradiated in the dark with light cast from the fixed enzyme layer 5 side, preferably with rays capable of best controlling the enzymatic activity, for example, ultraviolet rays of wavelengths 2000 to 3700 Å in this case, according to the pattern to be recorded. Thus, the fixed enzyme has a lowered activity in the irradiated regions while retaining the original activity in the unirradiated regions. Hence a latent image due to the difference of the enzymatic activity is formed in the fixed-enzyme layer 5.

Figure 2:
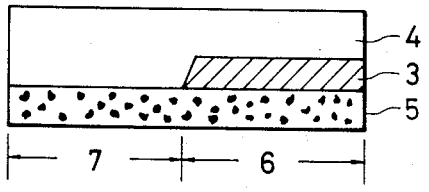
FIG. 2 is an illustration showing a state of the recording medium of FIG. 1 treated by a developing liquid.

Then the recording medium having the latent image is dipped in a developing liquid, i.e. water4 in this case. The contact with water initiates the enzyme-catalyzed decomposition of the starch in the recording layer 3. As shown in FIG. 2, the decomposition of starch proceeds rapidly in the unirradiated regions 7 where the original activity is retained, but scarcely in the irradiated regions 6 where the activity has been reduced. Since glucose, resulting from the starch decomposition, is soluble in water, the recording material copper phthalocyanine held by the starch in the unirradiated regions 7 is taken off along with the formed glucose. Finally, the copper phthalocyanine in the irradiated regions 6 remains forming an image on the recording medium. The medium is then dried at a temperature of 80°–200° C. for 15 minutes or more. Thereby, the decomposition of starch by the enzyme is stopped to fix the image in the medium.

While the enzyme itself is chemically modified with a photochromic substance spiropyrane in the aboveillustrated case for controlling the enzyme activity, recording similar to the above is also possible by using a collagen chemically modified with spiropyrane, as the carrier for fixing the enzyme. Further, similar recording is possible by using a fixed enzyme the activity of which increases on light irradiation. The recording medium may be provided with a transparent base layer on which the enzyme layer is formed.

The invention is illustrated in more detail referring to the following examples.

EXAMPLE 1

A mixture of collagen (1.0 g), acetone (100 ml), and anhydrous 3',3'-dimethyl-8-methoxy-6-nitrospiro[2H-1-benzo- pyrane-2,2'-indoline]-1'-propionic acid (300 mg) was stirred at room temperature for 20 hours. A 1% suspension (30 g) of collagen chemically modified with spiropyrane was allowed to react with amylase (30 mg) at pH 4.5 and spread on a Teflon sheet, and dried at room temperature for 15 hours. The coated sheet was immersed in a 0.1% glutaraldehyde solution for 1 minute, and then dried at 40° C., forming a sheet coated with a fixed-enzyme layer of 90 μm in thickness.

Starch (45 parts by weight; hereinafter "parts by weight" is abbreviated as "parts" and copper phthalocyanine (50 parts) were thoroughly mixed in a mortar, water (5 parts) was added thereto, and the mixture, heated to solution, was allowed to cool and convert into gel-like matter. This gel-like matter was spread on the fixed enzyme layer. Thus a recording medium was prepared which comprised a supported layer of fixed enzyme and a recording layer lying thereupon.

The recording medium was exposed to a pattern of 2200 Å ultraviolet rays for 30 seconds, and immersed for development in a water bath for 60 seconds while applying supersonic waves, giving a sharp image.

EXAMPLE 2

A mixture of collagen (1.0 g), acetone (100ml), and anhydrous 1,3,3-trimethylindolino-2-spiro-6'-benzopyrane (300 mg) was stirred at room temperature for 20 hours. A 1% suspension (30 g) of collagen chemically modified with spiropyrane was allowed to react with amylase (30 mg) at pH 4.5 and spread on a Teflon sheet, and dried at room temperature for 15 hours. The coated sheet was immersed in a 0.1% glutaraldehyde solution for 1 minute, and then dried at 40° C., forming a sheet coated with a fixed enzyme layer of 90 μm in thickness.

A 4% agar solution (10 g) was prepared by heating at 90°–100° C. To this solution were added 4-aminoantipyrin (1 part), a peroxidase (0.1 part), glucose (5 parts), and water (42.9 parts). The mixture was quickly spread on the fixed-enzyme layer. Thus a recording medium was prepared which comprised a supported layer of fixed enzyme and a recording layer lying thereupon.

The recording medium was exposed to a pattern of 2540 Å ultraviolet rays for 30 seconds, and then a 5% phenol solution and an enzymatic reaction inhibitor (diisopropylfluorophosphate) were applied on the medium, whereby a sharp and very stable image was obtained.

EXAMPLE 3

A solution of cis-2,3-dimethylcinnamoyl-imidazole (19.8 mg) in acetonitrile (2.0 ml) was added to 2 ml of aqueous trypsin solution (5 mg/ml) and allowed to stand for 15 minutes. To the mixed solution was added a solution of isatin acetate, indoxyl, and quinone (each 5 mg) in acetone (1 ml), and the pH was adjusted to 7.8. Using this mixture, trypsin was fixed in an acrylamide gel carrier.

The recording medium was irradiated with ultraviolet rays of 3130 |, heated at 60° C. for 15 minutes and then allowed to stand for 45 minutes. A color change from yellow to blue took place in the irradiated regions, resulting in a sharp image.

EXAMPLE 4

$C_{18}$ alkyl chains were introduced into α-chymotrypsin. A mixture of this alkylated chymotrypain and cis-cinnamoylpyrazole was dissolved in an organic solvent. The solution was dropped to water, forming a monomolecular layer on the water surface. A suitable surface pressure was applied to the layer to form a condensed film. While keeping this state, a clean glass base plate was sunk and taken up repeatedly across the monomolecular layer, forming a builtup film of 10 monomolecular layers. A solution of polyglutamate in methylene chloride was applied on this builtup film by a dip coating method, and dried.

The thus prepared recording medium was irradiated with ultraviolet rays cast from the rear side (glass plate side), and developed by immersing in water for 30 minutes, giving a sharp image of relief type formed of polyglutamate.

Effects brought about by the present invention are as follows:

(1) Utilization of enzymes for recording has become possible.

(2) It has become possible that a recording medium giving a sharp image is prepared by the simple operation of fixing an enzyme on carrier particles.

(3) The use of an enzyme makes unnecessary such expensive materials as used in conventional silver salt photography, simplifies operations such as development and fixing operations, and enables the reduction of operation time such as development time.

What is cliamed is:

1. An image recording process comprising:

(a) light-irradiating a recording medium according to a prerecorded pattern which recording medium comprises (1) a photosensitive layer comprising (i) an enzyme the activity of which can be increased or decreased by light irradiation and (ii) a carrier on which the enzyme is fixed and (2) a recording layer comprising a mixture of a recording material and a substance which is decomposable by the action of the enzyme only in the presence of a developing liquid and is removable by the developing liquid, to form a latent image in the photosensitive layer due to the difference in enzymatic activity in the irradiated and non-irradiated regions of the photosensitive layer; and (b) applying the developing liquid to the recording medium to decompose and remove the recording layer and develop a relief image.

2. The image recording process of claim 1, wherein the light for irradiating the recording medium is ultraviolet light of wavelengths 2000–3700 Å.

3. The image recording process of claim 1, wherein the enzyme is proteinase, tyrosinase, amylase, endopeptidase, urease, glucose oxidase, or macerating enzyme.

4. The image recording process of claim 1, wherein the recording material is copper phthalocyanine, thioindigo, indigo, diaminodiphenylmethane, benzanthrone, or melanine coloring matter.

5. The image recording process of claim 1, wherein the carrier is collagen, polyacrylamide, cellulose, or porous glass.

6. The image recording process of claim 1, wherein the substance decomposable by the enzyme is starch, protein, urea, glucose, tyrosin, milk casein, indoxyl acetate, isatin acetate, or polyglutamate.

7. The image recording process of claim 1, wherein the developing liquid is water.

8. The image recording process of claim 1, wherein the thickness of the enzyme layer is in the range of 40 to 100,000 Å.

9. The image recording process of claim 1, wherein the thickness of the recording layer is in the range of 40 to 100,000 Å.

* * * * *